US006344823B1

(12) United States Patent
Deng

(10) Patent No.: US 6,344,823 B1
(45) Date of Patent: Feb. 5, 2002

(54) STRUCTURE OF AN ANTENNA AND METHOD FOR MANUFACTURING THE SAME

(75) Inventor: Ten-Long Deng, HsinChu (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 09/716,433

(22) Filed: Nov. 21, 2000

(51) Int. Cl.[7] ..... H01Q 1/38

(52) U.S. Cl. ..... 343/700 MS; 343/846; 29/600

(58) Field of Search ..... 343/700 MS, 702, 343/828, 829, 830, 846, 848; 29/600

(56) References Cited

U.S. PATENT DOCUMENTS 5,355,142 A * 10/1994 Marshall et al. ..... 343/700 MS
6,133,883 A * 10/2000 Muson et al. ..... 343/700 MS
6,184,833 B1 * 2/2001 Tran ..... 343/700 MS
6,184,834 B1 * 2/2001 Utsumi et al. ..... 343/702

* cited by examiner

*Primary Examiner*—Tan Ho
(74) *Attorney, Agent, or Firm*—Birch, Stewart, Kolasch & Birch, LLP

(57) ABSTRACT

A structure for an Inverted-F antenna includes: a radiating portion forming a longitudinal side of the Inverted-F antenna, a support portion integrally formed with the radiating portion and perpendicularly connected to the radiating portion, a feed-in portion integrally forming a center extending portion of the Inverted-F antenna and a signal transmission line connected to the feed-in portion and the ground plane for signal transmission between the antenna and a connected communication host. The signal transmission line includes a core wire and a ground wire. The core wire is connected to the feed-in portion and the ground wire is connected to the ground plane. The antenna is capable of keeping a stable radio frequency characteristic with its simple and compact structure.

19 Claims, 5 Drawing Sheets

STRUCTURE OF AN ANTENNA AND METHOD FOR MANUFACTURING THE SAME

BACKGROUND OF INVENTION

1. Field of the Invention

The present invention relates to an antenna and particularly to an omnidirectional wireless LAN antenna and a cost-effective method for producing the same.

2. Description of the Prior Art

An antenna is used for wireless radio frequency communications, including wireless local loop (WLL) services, cellular mobile radiotelephone (CMR) services, and personal communications services (PCS). An omnidirectional radio frequency antenna is commonly used at the central site for providing communication links between a central fixed site and multiple remote sites. Typically, the antenna is one half or one quarter of a wavelength in length along at least one axis and as such cannot easily be reduced.

One type of a low-profile antenna is an Inverted-F Antenna (IFA) as shown in FIG. 1. A radiating portion 122 is connected to the end of the vertical element 124 of an inverted-L Antenna 12. A signal transmission line 16 is soldered to the radiating portion 122 for signal transmission between the antenna 12 and a communication host. The appearance of the antenna is like a letter F facing the ground plane 14.

However, the conventional method for manufacturing an IFA antenna has difficulties in keeping the RF characteristics stable due to the antenna structure and the poor error tolerance in the manufacture process. For instance, the soldering of the signal transmission line 16 may easily cause a frequency drift.

For optimal transmission and reception of electromagnetic signals, it is desirable to provide an improved antenna structure and the method for producing such an antenna which can keep the RF characteristics stable.

Moreover, the conventional method for manufacturing such an antenna is not efficient enough. It is desirable to provide an antenna with an improved structure to overcome the problems of the prior arts, thereby to increase the yield rate in mass production.

SUMMARY OF THE INVENTION

It is a primary object of the present invention to provide an improved structure for an Inverted-F antenna which is compact, cost-effective and environmentally robust.

It is another object of the present invention to provide a method for manufacturing an omnidirectional Inverted-F antenna which can easily keep the RF characteristics of the inverted-F antenna stable.

According to an aspect of the invention, the invention provides an improved structure of the antenna. The improved structure includes: a radiating portion forming a longitudinal side of the Inverted-F antenna, a support portion perpendicularly connected to the radiating portion, a feed-in portion integrally forming a center extending portion of the Inverted-F antenna and a signal transmission line connected to the feed-in portion and the ground plane for signal transmission between the antenna and a communication host. The ground plane, the support portion, and the radiating porting are integrally formed. The signal transmission line includes a core wire and a ground wire. The core wire is connected to the feed-in portion and the ground wire connected to the ground plane.

According to another aspect of the invention, the invention provides a method for manufacturing an antenna. The method includes the steps of: (a). Form a rectangular pattern and an Inverted-F pattern facing the rectangular pattern on a uniform conductor plane by punching. The Inverted-F pattern includes a radiating portion, a support portion, and a feed-in portion. The bottom end of the support portion is connected to the rectangular pattern. (b). Bend the support portion to a horizontal plane perpendicular to the rectangular pattern. And (c). Solder a core wire of a signal transmission line to the radiating portion and a ground wire of a signal transmission line to the ground plane.

BRIEF DESCRIPTION OF DRAWINGS

These and other objects and advantages of the present invention will become apparent when considered in view of the following description and accompanying drawings wherein.

DETAILED DESCRIPTION OF PREFERRED EMBODIMENT

The antenna of the invention is for transmitting/receiving radio frequency (RF) signals for a wide variety of wireless communications applications, including wireless local loop (WLL) services, cellular mobile radiotelephone services, and personal communications services.

Figure 1:
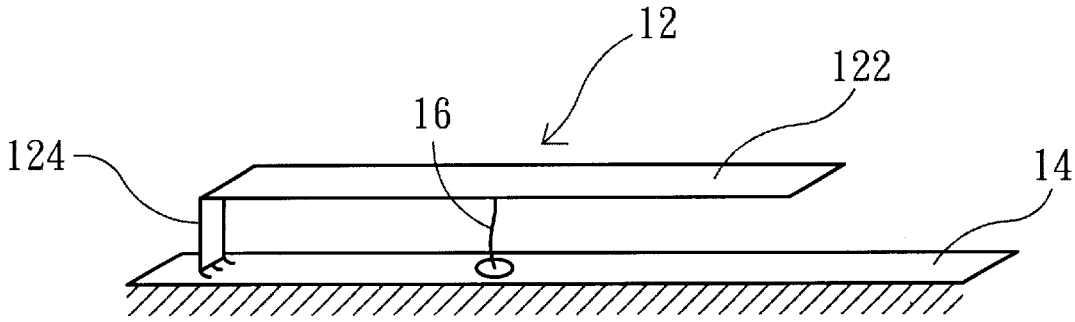
Fig. 1 (PRIOR ART)
FIG. 1 is a side view schematically showing the structure of a conventional Inverted-F antenna.
Figure 2:
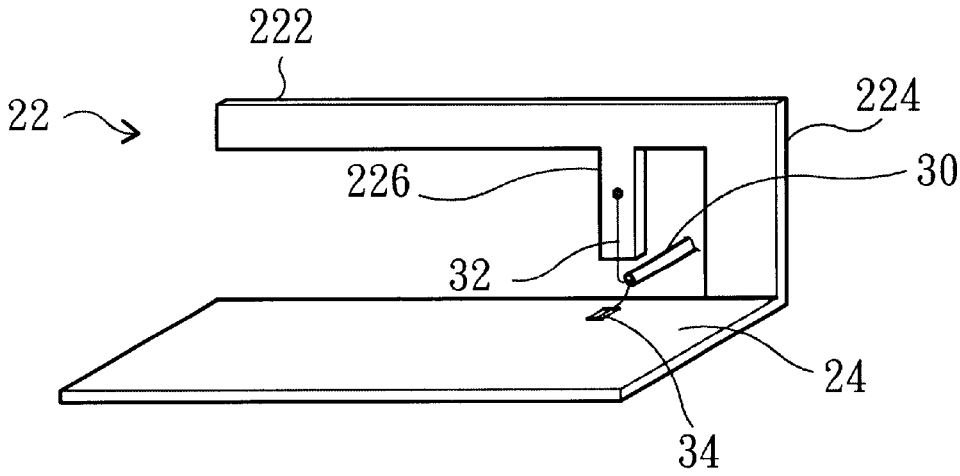
FIG. 2 is a side view schematically showing the structure of an Inverted-F antenna according to a preferred embodiment of the present invention.

The improved Inverted-F structure of the antenna is illustrated in FIG. 2. Refer to FIG. 2, the antenna 22 includes a radiating portion 222, a support portion 224, a feed-in portion 226, a ground plane 24, and a signal transmission line 30. The Inverted-F structure is integrally formed with the ground plane 24 by molding or stamping. The signal transmission line 30 includes a core wire 32 and a ground wire 34. The signal transmission line 30 connects the feed-in portion 226 and a communication host (not shown) for transmitting the radio frequency signals to the communication host. The size of the ground plane 24 determines the quality of radio frequency transmission. A relatively large ground plane can provide better quality of radio frequency transmission.

Figure 3A:
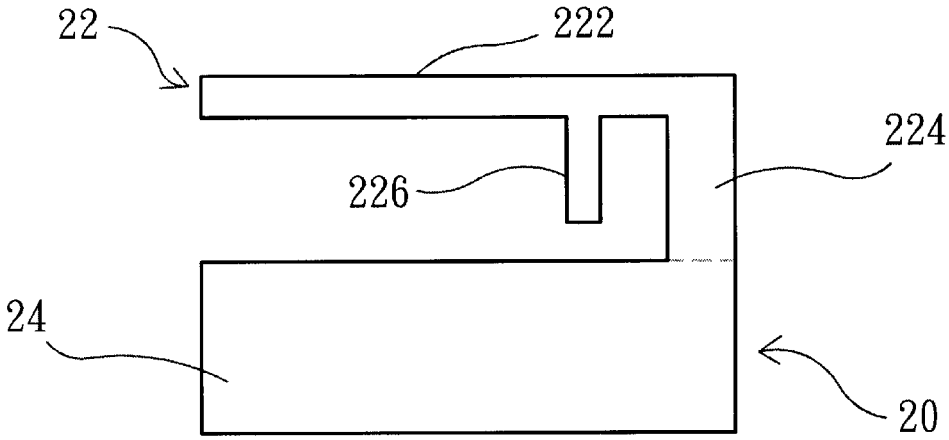
FIGS. 3A~3B are schematic diagrams showing the steps for producing the Inverted-F antenna as shown in FIG. 2 according to the preferred embodiment of the present invention.

The method of manufacturing the antenna as shown in FIG. 2 includes: first, form the rectangular ground plane 24 and the Inverted-F pattern 22 facing the rectangular pattern 24 by molding or stamping on a conductor plane. To increase the error tolerance in manufacturing process, the size and shape of the Inverted-F pattern and the rectangular pattern 24 can be computed and simulated by a computer in advance. The resultant structure is shown in FIG. 3A.

Figure 3B:
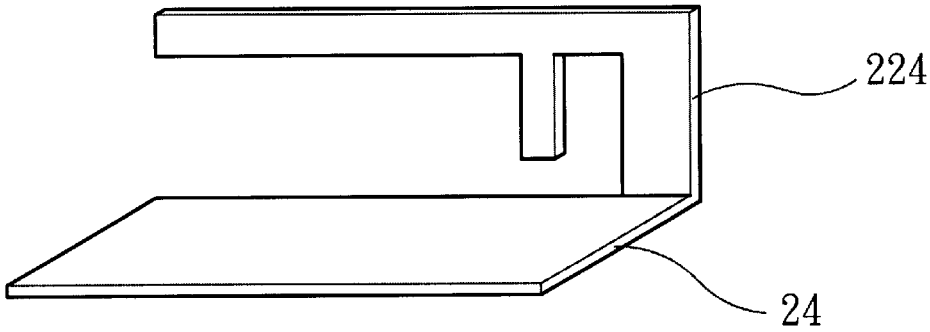

And then, fold the support portion 224 of the Inverted-F pattern to be perpendicular to the ground plane 24 by human labor or stamping. The resultant structure is shown in FIG. 3B.

After that, provide a signal transmission line 30 which includes a core wire 32 and a ground wire 34. The core wire 32 is connected to the feed-in portion 226 by soldering or welding. The ground wire 34 is connected to the ground plane 24. The other end of the signal transmission line 30 is connected to a communication host for transmitting radio frequency to the communication host. The resultant structure of the antenna is shown in FIG. 2.

The method for manufacturing the antenna is simple and cost-effective. The punching technology involved allows a mass production of the antennas with an improved yield rate. Moreover, since the main structure of the antenna is integrally formed, so the impedance matching will not be changed due to the connection structure of the antenna. Thus, the impedance can be stably maintained because the size of the solder points and the quality of connections have been improved according to the preferred embodiment of the invention. Furthermore, since the feed-in point of the present invention is formed by connecting the feed-in portion 226 with the core wire 32 of the signal transmission line 30, and the length of the feed-in portion 226 is proportional to the height of the support portion 224, so the frequency drift problem can be overcome.

Figure 4:
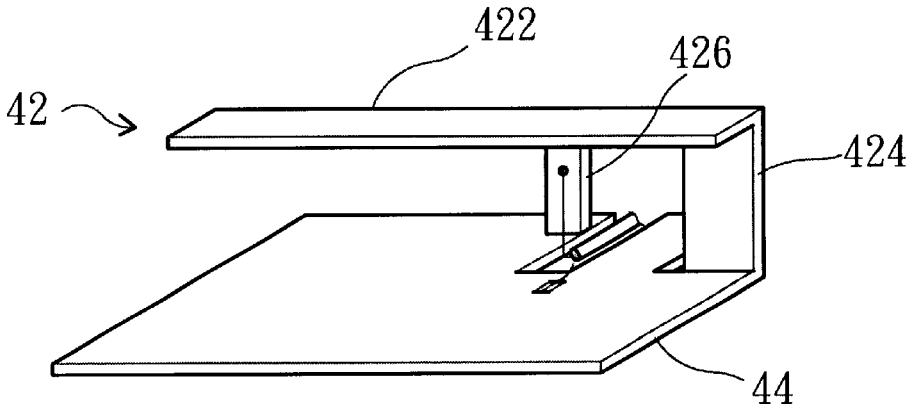
FIG. 4 is a side view showing the structure of an Inverted-F antenna according to another embodiment of the present invention.

When the antenna is employed in mobile telecommunications handsets, its size can be further reduced by folding the radiating portion to a horizontal plane parallel to the ground plane. FIG. 4 shows the structure of an Inverted-F antenna according to another embodiment of the present invention.

Figure 5A:
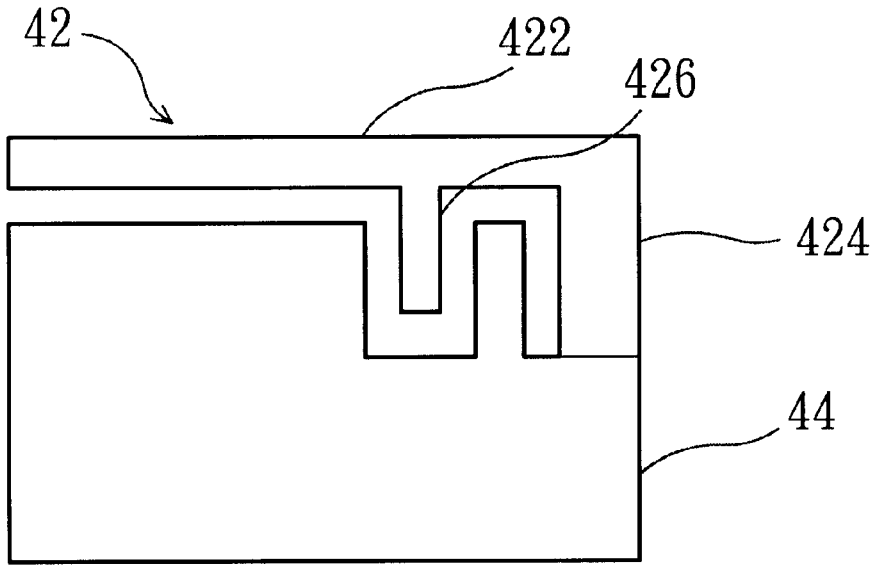
FIGS. 5A~5B are schematic diagrams showing the method for manufacturing the Inverted-F antenna as shown in FIG. 4 according to another embodiment of the present invention.

The method of manufacturing the antenna as shown in FIG. 4 includes: first, compute and simulate the pattern of the inverted F-shaped pattern with a ground plane having a shape complementary to the shape of an "F". Then, mold and stamp a conductor plane to form the pattern of the Inverted-F antenna according to the pattern and specification as computed. Refer to FIG. 5A, on a conductor plane, the pattern of the inverted-F antenna includes a radiating portion 422, a support portion 424, a feed-in portion 426 and a ground plane 44.

After the pattern is formed, the ground plane 44 is bent perpendicular to the radiating portion 422 by human labor or stamping. The resultant structure is shown in FIG. 5A.

Figure 5B:
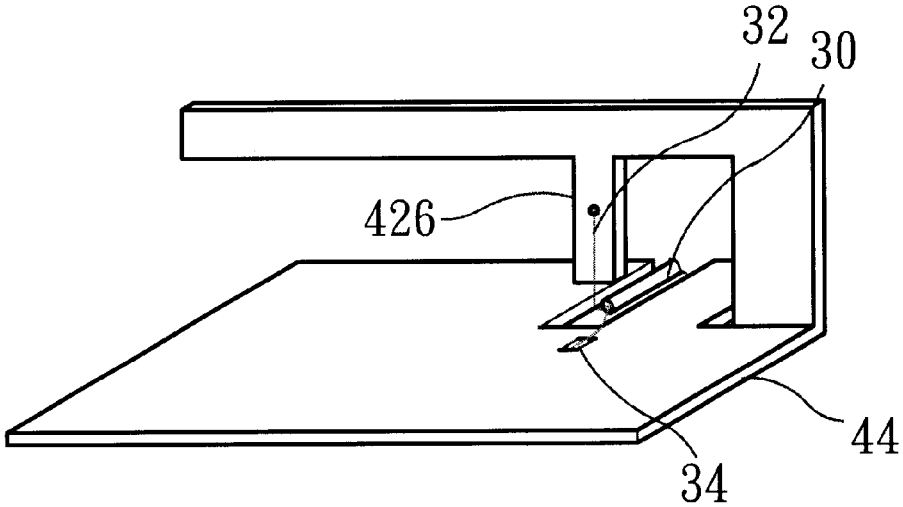

After that, provide a signal transmission line 30 which includes a core wire 32 and a ground wire 34. The core wire 32 is connected to the feed-in portion 426 from one end of the signal transmission line 30 by means of soldering or welding. The ground wire 34 is connected to the ground plane 44 from the same end of the signal transmission line 30. The other end of the signal transmission line 30 is connected to a communication host. The resultant structure of the antenna is shown in FIG. 5B.

After that, bent the radiating portion 422 of the antenna 42 to be parallel with the surface side of the ground plane 44. The resultant structure is shown in FIG. 4.

Since the ground plane 44 has a larger area than the one of FIG. 2, so it can be more robust in various environmental situations by exhibiting different effects of impedance matching.

To sum up, the antenna of the invention has an improved structure which can be easily made by stamping or punching. Accordingly, the improved antenna structure can generate a higher yield rate when put into mass production. The improved antenna structure is also compact in size so that it can be easily implemented in a handset of a mobile communication device.

It should be understood that various alternatives to the structures described herein may be employed in practicing the present invention. It is intended that the following claims define the invention and that the structure within the scope of these claims and their equivalents be covered thereby.

What is claimed is:

1. An Inverted-F antenna, comprising:

a radiating portion forming a longitudinal side of said Inverted-F antenna;

a support portion perpendicularly and integrally formed with said radiating portion;

a feed-in portion integrally formed with said radiating portion and forming a center extending portion of said Inverted-F antenna, the feed-in portion being at an edge of the radiating portion;

a ground plane integrally formed with said support portion; and a signal transmission line having a core wire and a ground wire for transmitting radio frequency into a connected communication host, said core wire being connected to said feed-in portion and said ground wire being connected to said ground plane.

2. The Inverted-F antenna as claimed in claim 1, wherein said radiating portion, said support portion, said feed-in portion, and said ground plane are made of a conductor plane.

3. The Inverted-F antenna as claimed in claim 1, wherein the ground plane has a side edge and the support portion extends perpendicularly from the side edge of the ground plane.

4. The Inverted-F antenna as claimed in claim 1, wherein the radiating portion and the ground plane extend in planes generally perpendicular to one another.

5. The Inverted-F antenna as claimed in claim 1, wherein the radiating portion and the ground plane extend in planes generally parallel to one another.

6. The Inverted-F antenna as claimed in claim 1, wherein an opening is provided in the ground plane, the signal transmission line being located in the opening, the signal transmission line in the opening being generally perpendicular to the feed-in portion.

7. The Inverted-F antenna as claimed in claim 1, wherein the support portion and the feed-in portion are generally coplanar.

8. The Inverted-F antenna as claimed in claim 1, wherein the support portion, the feed-in portion and the radiating portion are generally coplanar.

9. The Inverted-F antenna as claimed in claim 1, wherein the feed-in portion is unbent with respect to the radiating portion.

10. A method for manufacturing an Inverted-F antenna, comprising the steps of:

(a) forming a rectangular ground plane and an Inverted-F pattern facing said rectangular ground plane on a conductor plane by punching, said Inverted-F pattern including a radiating portion, a support portion, and a feed-in portion, said support portion being connected to said rectangular ground plane and the feed-in portion being at an edge of the radiating portion;

(b) bending said support portion to be perpendicular to said rectangular ground plane;

(c) providing a signal transmission line having a core wire and a ground wire for transmitting radio frequency to a connected communication host; and (d) connecting said core wire to said radiating portion and said ground wire to said rectangular ground plane.

11. The method as claimed in claim 10, further comprising the step of:

(e) bending said radiating portion to a horizontal plane parallel to said ground plane.

12. The method as claim 10, wherein the support portion and the feed-in portion are formed generally coplanar with one another.

13. The method as claimed in claim 10, wherein the support portion, the feed-in portion and the radiating portion are formed generally coplanar with one another.

14. The method as claimed in claim 10, wherein the feed-in portion is unbent with respect to the radiating portion.

15. A method for manufacturing an Inverted-F antenna, comprising the steps of:

(a) forming an Inverted-F pattern and a ground plane having a complementary Letter F shape on a conductor plane by punching, said Inverted-F pattern including a radiating portion, a support portion, and a feed-in portion, said support portion being connected to said ground plane and the feed-in portion being at an edge of the radiating portion;

(b) bending said support portion to be perpendicular to said ground plane;

(c) providing a signal transmission line having a core wire and a ground wire for transmitting radio frequency to a connected communication host; and (d) connecting said core wire to said radiating potion and said ground wire to said ground plane.

16. The method as claimed in claim 5, further comprising the step of:

(e) bending said radiating portion to a horizontal plane parallel to said ground plane.

17. The method as claimed in claim 15, wherein the support portion and the feed-in portion are formed generally coplanar with one another.

18. The method as claimed in claim 15, wherein the support portion, the feed-in portion and the radiating portion are formed generally coplanar with one another.

19. The method as claimed in claim 15, wherein the feed-in portion is unbent with respect to the radiating portion.

* * * * *